US006863040B2

(12) United States Patent
Kataoka et al.

(10) Patent No.: US 6,863,040 B2
(45) Date of Patent: Mar. 8, 2005

(54) ROCKER ARM

(75) Inventors: Masahiko Kataoka, Iwata (JP); Toshiyuki Kobashi, Iwata (JP); Katsufumi Abe, Iwata (JP)

(73) Assignee: NTN Corporation, Osaka (JP)

( * ) Notice: Subject to any disclaimer, the term of this patent is extended or adjusted under 35 U.S.C. 154(b) by 0 days.

(21) Appl. No.: 10/634,762

(22) Filed: Aug. 6, 2003

(65) Prior Publication Data

US 2004/0035382 A1 Feb. 26, 2004

(30) Foreign Application Priority Data

Aug. 20, 2002 (JP) ..... 2002-238745

(51) Int. Cl.[7] ..... F01L 1/18

(52) U.S. Cl. ..... 123/90.39; 123/90.43; 123/90.44; 29/888.2

(58) Field of Search ..... 123/90.39, 90.43, 123/90.44, 90.15, 90.16, 90.17, 90.4, 90.41, 90.45; 411/223, 301, 83, 87; 29/888.2; 74/559, 567, 569

(56) References Cited

U.S. PATENT DOCUMENTS 2,439,415 A * 4/1948 Bloomfield ..... 411/223
3,030,997 A * 4/1962 Collins ..... 411/301
4,249,488 A * 2/1981 Siegla ..... 123/90.16
4,790,703 A * 12/1988 Wing ..... 411/260
4,990,044 A * 2/1991 Kimak ..... 411/427
5,022,791 A * 6/1991 Isler ..... 405/259.5
5,678,305 A * 10/1997 Nagano et al. ..... 29/888.2
5,682,847 A * 11/1997 Hara ..... 123/90.16
5,960,617 A * 10/1999 Sheldon ..... 56/17.5
6,027,293 A * 2/2000 Beemer et al. ..... 411/119
6,601,555 B2 * 8/2003 Okubo et al. ..... 123/90.39
6,749,386 B2 * 6/2004 Harris ..... 411/544

* cited by examiner

*Primary Examiner*—Thomas Denion
*Assistant Examiner*—Ching Chang

(57) ABSTRACT

To provide a rocker arm of a design effective to avoid occurrence of a loosening of the adjustment screw to ensure a proper operation of the internal combustion engine including the control of the opening of the valve body on the engine cylinder head, the rocker arm 1 is of a type capable of being rockingly driven by a cam 2 for selectively opening and closing a valve of an internal combustion engine. The rocker arm 1 includes an arm body 4 prepared from a steel plate by means of a press work to have a generally inverted U-shaped section. The arm body 4 has one end formed with an internally threaded hole 12 into which an adjustment screw 7 is threaded. This adjustment screw has one end defining a pivot piece 7*b* or a valve drive piece 7Ab. Two nuts 13 and 14 are threadingly mounted in overlapping relation to each other on one end portion of the adjustment screw 7 protruding outwardly from the arm body. Instead of the use of the two nuts 13 and 14, a flanged nut may be employed or a single nut 13 in combination with a washer 17 may be employed.

8 Claims, 5 Drawing Sheets

ROCKER ARM

BACKGROUND OF THE INVENTION

1. Field of the Invention

The present invention generally relates to a rocker arm adapted to be rockingly driven by a cam for selectively opening and closing a valve mounted on a cylinder head of an internal combustion engine and, more particularly, to the mounting of an adjustment screw for adjusting the opening of the valve.

2. Description of the Prior Art

The rocker arm currently in use is generally available in two models depending on the position of the pivot fulcrum about which the rocker arm undergoes a rocking motion; a screw-locked model in which the adjustment screw is fixed on the arm body and a valve drive model in which the adjustment screw is held in abutment with a post on the engine cylinder head. In addition, each of those models is also available in two types; a center pivot type, in which the rocker arm is rockingly supported at a generally intermediate portion thereof, and an end pivot type in which the rocker arm is pivotally supported at one of its opposite ends through a pivot element secured to such one of the opposite ends.

In the screw-locked model, the rocker arm body is formed with a screw hole in which the adjustment screw is threaded and is then locked in position by means of a fastening nut. This adjustment screw employed in the end pivot type has one end formed with a pivot piece. On the other hand, the adjustment screw employed in the center pivot type has one end formed with a valve abutment. In either type, the adjustment screw is utilized to adjust the opening of a valve body on the engine cylinder head. Accordingly, if the adjustment screw once locked in position is undesirably loosened, not only does the controlled opening of the valve body vary correspondingly, but also it will constitute a cause of generation of noises and vibrations.

Hitherto, the adjustment screw employed in the rocker arm is locked in position on the rocker arm body by means of a single fastening nut with a fastening torque controlled carefully. However, in order for the screw fastening structure to function assuredly, it is necessary for a pre-tensioning force for urging in an axial direction of the screw to be given and retained.

It has, however, been found that with the single fastening nut, the adjustment screw cannot be fastened sufficiently and, therefore, the pre-tensioning force that ought to be retained by, for example, the effect of friction decreases for any reason, accompanied by an incipiency of the adjustment screw to undo. The loosening of the adjustment screw is due to various causes. So far as the single fastening nut is employed as discussed above, for example, depression of the nut seat, on which the single fastening nut threadingly mounted on the adjustment screw is firmly fastened, tends to proceed and, in the worst case, the adjustment screw will be eventually loosened and/or the backlash will undesirably occur between male threads and female threads.

In recent years, the rocker arm of a type prepared from a plate metal by the use of a press work to represent a generally inverted U-sectioned configuration is increasingly employed since as compared with the rocker arm prepared by the use of a metal casting technique, it has numerous advantages such as a light-weight feature, a reduced number of manufacturing steps, a reduced cost of manufacture and others. The adjustment screw mounting structure discussed hereinabove is employed even in this rocker arm. However, the rocker arm of the type prepared from the plate metal has a major problem: Specifically, in the rocker arm of the type prepared from the plate metal, the depth of the screw hole for receiving the adjustment screw is more or less limited due to the limited wall thickness available and, accordingly, it is very difficult for the adjustment screw to be locked in position without accompanying a loosening.

SUMMARY OF THE INVENTION

In view of the foregoing, the present invention has for its object to provide a rocker arm of a design effective to avoid occurrence of a loosening of the adjustment screw to ensure a proper operation of the internal combustion engine including the control of the opening of the valve body on the engine cylinder head.

In order to accomplish the foregoing object of the present invention, there is provided a rocker arm capable of being rockingly driven by a cam for selectively opening and closing a valve mounted on a cylinder head of an internal combustion engine. The rocker arm in accordance with the present invention includes an arm body having first and second ends opposite to each other, with an internally threaded hole defined in the first end of the arm body. An adjustment screw which serves as a pivot member or a valve drive member is threaded into the internally threaded hole in the first end of the arm body with one end portion of the adjustment screw protruding outwardly from the first end of the rocker arm. This adjustment screw is fixed relative to the arm body in one of the following manners.

In one aspect of the present invention, a first fastening system is employed in which two nuts are threaded onto such one end portion of the adjustment screw, then received in the internally threaded hole, in overlapping relation with each other. In other words, a double nut system is employed to fix the adjustment screw relative to the arm body.

This first fastening system may be referred to as a double nut fastening system and is effective to substantially eliminate any occurrence of backlash between the external helical thread of the adjustment screw and the internal helical thread of the internally threaded hole to thereby eliminate occurrence of a loosening of the adjustment screw. Because of this, a proper operation of the internal combustion engine such as a proper control of the opening of the valve body on the engine cylinder head can be ensured.

It is to be noted that since the adjustment screw is threadingly engaged in the internally threaded hole, the backlash removal action as the standard double nuts can be obtained from the internally threaded hole and the nut to a certain extent even where a single nut is employed. However, the internally threaded hole defined in the arm body is ineffective to exert the backlash removal action sufficiently and, therefore, the use of the two nuts in combination with the internally threaded hole such as discussed above is effective to assuredly eliminate the backlash to thereby prevent the adjustment screw from being possibly loosened.

In another aspect of the present invention, a second fastening system is employed in which instead of the use of the double nuts discussed above, a flanged nut is employed. In other words, the flanged nut is firmly threaded onto such one end portion of the adjustment screw.

Where the flanged nut is employed, the surface area of contact between the flanged nut and the arm body can be advantageously increased and, therefore, a localized concentration of the pressure which would otherwise be imposed by the nut on a relatively narrow region of the arm body if no flange were formed in such nut can be lessened. Accordingly, the possibility can be substantially eliminated or reduced in which an annular surface portion of the arm body aligned with an annular end face of the nut may be undesirably depressed and, therefore, an undesirable loosening of, or backlash, of the adjustment screw relative to the arm body can advantageously be eliminated.

If desired, one of the double nuts referred to above, which is positioned adjacent the arm body, may be a flanged nut. In such case, not only can the backlash removal action be obtained by the use of the double nuts, but any undesirable depression of an annular surface portion of the arm body aligned with an annular end face of the nut can also be eliminated because of the use of the flanged nut, thereby providing a highly ensured loosening removal effect.

In a third aspect of the present invention, a third fastening system is employed in which instead of the use of the flanged nut referred to above, a washer is employed in combination with a nut. More specifically, the nut is threaded onto such one end portion of the adjustment screw with a washer intervening between such nut and the first end of the arm body.

With the third fastening system, the intervention of the washer between the nut and the annular portion of the arm body is effective to allow the contact pressure, acting from the nut on that annular portion of the arm body, to be distributed over a relatively large surface region of the arm body, to thereby facilitate avoidance of the undesirable loosening or backlash of the adjustment screw relative to the arm body which would otherwise occur when depression takes place in that annular portion of the arm body in contact with the nut.

Consequent upon the employment of one of the first to third fastening systems in accordance with the present invention, any undesirable loosening of the adjustment screw can effectively be eliminated and, therefore, a proper operation of the internal combustion engine such as a proper control of the opening of the valve body on the engine cylinder head can be ensured.

In the practice of the present invention, the arm body may be prepared from a single plate metal by means of a press work to represent a generally inverted U-sectioned configuration including a pair of opposite side walls and a connecting wall bridging between the opposite side walls.

In terms of reduction in weight, number of manufacturing steps and cost, the arm body prepared from the use of the plate metal is advantageous and, because of the generally inverted U-shaped cross-section represented by the arm body, a sufficient physical strength can also be secured in general portions. However, the arm body prepared from the use of the plate metal appears to have a drawback in that due to the limited wall thickness available, the depth of the internally threaded hole for receiving the adjustment screw is more or less limited and is, hence, difficult to be firmly fastened.

However, according to the present invention, when one of the first to third fastening systems is employed, the adjustment screw can be locked in position without allowing it to be loosened and, therefore, one of demerits of the rocker arm of a kind prepared from the plate metal can advantageously be compensated for, thereby making it possible to provide a comprehensively excellent rocker arm.

Where the arm body is prepared from the plate metal to represent the generally inverted U-sectioned configuration, respective portions of mutually confronting inner surfaces of the opposite side walls may be formed with helical partial threads therein in continuity with an internally helically extending thread of the internally threaded hole for threadingly receiving the adjustment screw.

Where the partial threads are defined in the respective inner surfaces of the opposite side walls in face-to-face relation with each other as described hereinabove, the adjustment screw can be engaged not only with the arm body through the internally threaded hole defined in the arm body, but also with the opposite side walls through the partial threads. Thus, those portions of the opposite side walls can be utilized to define an extension of the internal helical thread of the internally threaded hole and, therefore, the adjustment screw can firmly be threaded at an increased threading strength. Accordingly, with no need to increasing the wall thickness of the plate metal used as a material for the arm body, a sufficient threading strength and a sufficient strength of that portion of the arm body adjacent and around the internally threaded hole can be effectively secured.

The present invention is applicable to the rocker arm of any of the end pivot type and the center pivot type. Where the present invention is applied to the end pivot type, the adjustment screw employed in the rocker arm employing any one of the first to third fastening systems discussed hereinbefore may include a pivot piece provided at one end thereof while the arm body may include a valve abutment defined at one of its opposite ends for engagement with a valve member. In this case, the roller contacting the cam is rotatably supported at a generally intermediate portion of the arm body.

On the other hand, where the present invention is applied to the center pivot type, the adjustment screw employed in the rocker arm employing any one of the first to third fastening systems discussed hereinbefore may have one end provided with a valve drive piece while the arm body is supported at a generally intermediate portion thereof for rocking motion and a roller engageable with the cam is fitted to the other end of the arm body.

Regardless of whether it is of the end pivot type or whether it is of the center pivot type, the adjustment screw used in the rocker arm of the structure described hereinabove is employed to control the opening of the valve. Considering that any of the foregoing structures designed in accordance with the present invention is effective to substantially eliminate an undesirable loosening of the adjustment screw as hereinbefore discussed, a proper operation of the internal combustion engine such as a proper control of the opening of the valve body on the engine cylinder head can be ensured advantageously.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
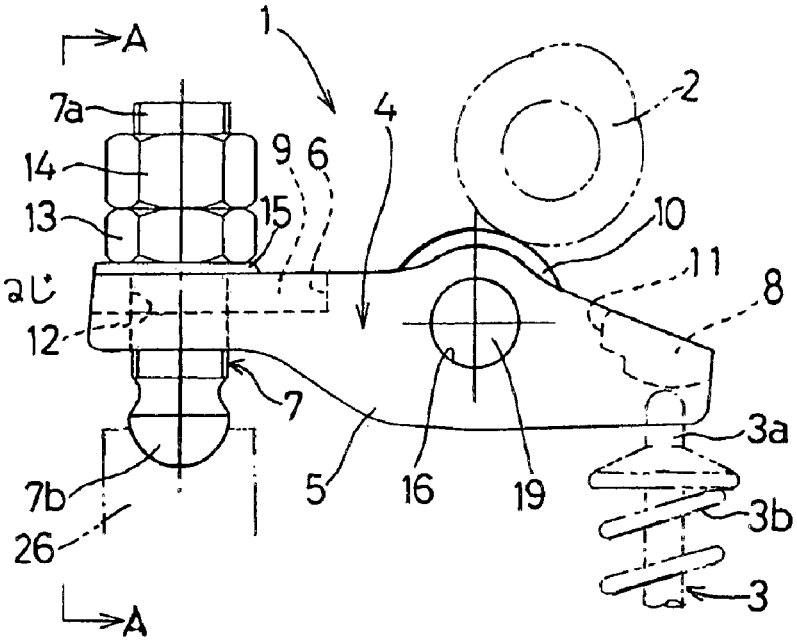
FIG. 1 is a schematic side view of a rocker arm according to a first preferred embodiment of the present invention.

A first preferred embodiment of the present invention will now be described with particular reference to FIGS. 1 to 4. A rocker arm 1 shown therein is mounted on an internal combustion engine and above a cylinder head (not shown) in a well known manner and is utilized to operate, i.e., selectively open and close a valve body (not shown), located at a lower end of a valve member 3, particularly a valve stem 3*a* of the valve member 3, as the rocker arm 1 is rocked by an overhead cam 2. The rocker arm 1 shown therein is of an end pivot type in which the rocker arm 1 is received at one end thereof in a pivot seat 26 defined in the engine cylinder head in the form of an internally rounded recess. The illustrated rocker arm 1 carries an adjustment screw 7 which serves as a pivot member and which threadingly extends through such one end of the rocker arm 1. The adjustment screw 7 includes an externally helically threaded screw shank 7*a* having a lower end formed integrally with, or otherwise defining, a pivot piece 7*b* that is slidingly received in the pivot seat 26. The pivot piece 7*b* is preferably of a semi-spherical configuration and, correspondingly, the pivot seat 26 is recessed to represent a semi-spherical configuration mating with the shape of the rounded pivot piece 7*b*.

The other end of the rocker arm 1 remote from the adjustment screw 7 is provided with a valve abutment 8 engageable with an upper end of the valve stem 3*a* that is normally biased upwardly, as viewed in FIG. 1, by a compression spring 3*b* that is located therearound and seated at one end against the engine cylinder head and at the opposite end against a spring retainer mounted on the valve stem 3*a*. The valve stem 3*a* moves up and down depending on the action of the cam 2. A portion of the rocker arm 1 generally intermediate of the length thereof and between the adjustment screw 7 and the valve abutment 8 has a roller (a cam follower) 10 rollingly contacting the overhead cam 2 which in turn causes the valve body at that lower end of the valve stem 3*a*, opposite to the upper end 3*a* thereof, to open and close as the rocker arm 1 pivots substantially about the center of curvature of the rounded pivot piece 7*b*. The rocker arm 1 is held in position above the engine cylinder head by means of the cam 2, the pivot seat 26 and the valve stem 3*a*.

Figure 2A:
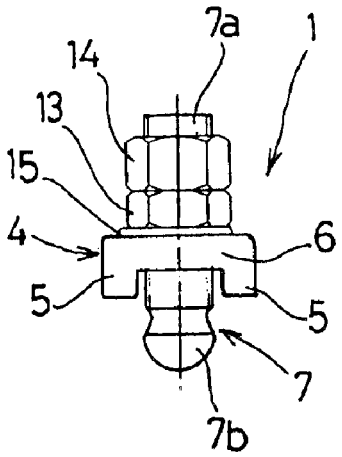
FIG. 2A is an end view of the rocker arm of FIG. 1 as viewed in a direction A—A in FIG. 1.
Figure 2B:
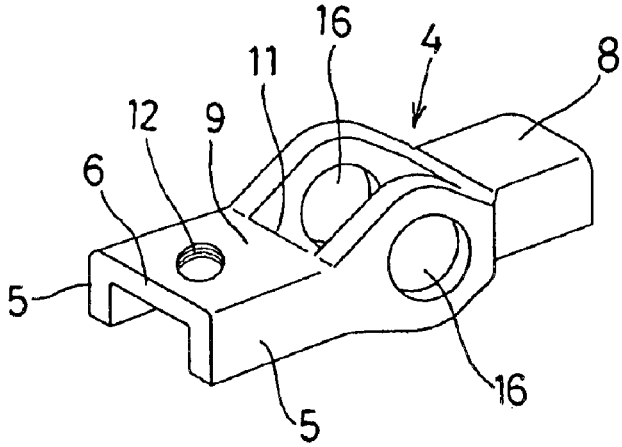
FIG. 2B is a schematic perspective view of an arm body of the rocker arm shown in FIG. 1.

More specifically, as best shown in FIGS. 2A and 2B, the rocker arm 1 includes a generally elongated arm body 4 of a generally inverted U-sectioned configuration opening downwardly. This arm body 4 is of one-piece construction prepared from a single plate metal such as a steel plate by the use of any known press work and including a pair of parallel side walls 5 and a top connection wall 6 bridging between those side walls 5. The connecting wall 6 is positioned on one side opposite to the valve member 3 while the upper end of the valve stem 3*a* extends between respective portions of the side walls 5 adjacent the valve abutment 8 so as to terminate in abutment with the valve abutment 8. Extension of the upper end of the valve stem 3*a* between those portions of the side walls 5 is effective to prevent transverse or lateral motion of the rocker arm 1 in a direction perpendicular to the plane in which the rocker arm 1 undergoes a rocking position.

The illustrated arm body 4 has a side profile which may be either substantially straight or be angled, but in the embodiment shown therein it represents a generally straight profile. While the side walls 5 extend over the entire length of the rocker arm 1, the top connecting wall 6 from which the opposite side walls 5 depend has a generally intermediate portion depleted to define a roller window 11 from which the roller 10 is partially exposed for contact with the overhead cam 2. One end portion of the top connecting wall 6 adjacent the valve stem 3 defines the valve abutment 8 while the opposite end portion thereof defines a screw mount 9 for receiving the adjustment screw 7.

The screw mount 9 of the top connecting wall 6 has an internally helically threaded hole 12 defined therein, and the adjustment screw 7 is adjustably supported by the screw mount 9 with the externally helically threaded screw shank 7*a* of the adjustment screw 7 engaged in the internally helically threaded hole 12. With the adjustment screw 7 so supported by the screw mount 9 in the top connecting wall 6, an upper end portion of the screw shank 7*a* opposite to the rounded pivot piece 7*b* extends outwardly upwardly from the screw mount 9. Fastening and lock nuts 13 and 14 are threadingly mounted on the upper end portion of the screw shank 7*a* in tight contact with each other to thereby firmly fix the adjustment screw 7 in position carried by the arm body 4. It is to be noted that in order that the nuts 13 and 14 can provide a backlash removal action as double nuts, the fastening nut 13 is, once threaded onto the upper end portion of the screw shank 7*a* followed by fastening of the lock nut 14, somewhat undone to firmly contact the lock nut 14.

Figure 3A:
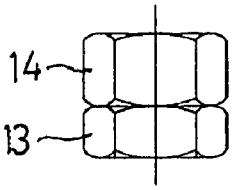
FIG. 3A is a side view of double nuts employed in the rocker arm of FIG. 1.
Figure 3B:
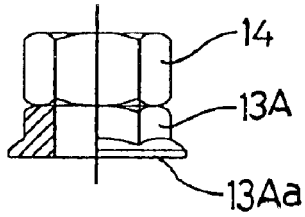
FIG. 3B is a side view of the double nuts of a different configuration that can be employed in the rocker arm of the present invention.

In the illustrated embodiment each of the nuts 13 and 14 is employed in the form of a hexagonal nut as shown in FIG. 3A. However, of those nuts 13 and 14, the fastening nut 13 adjacent the arm body 4 may be in the form of, for example, a flanged nut 13A having a radially outwardly extending flange 13Aa as shown in FIG. 3B. Also, as best shown in FIGS. 1 and 2A, a portion of the upper surface of the top connecting wall 6 around the internally threaded hole 12 may be raised upwardly to define a flat-topped nut seat 15 onto which the fastening nut 13 engaged on the screw shank 7*a* of the adjustment screw 7 can be firmly seated. The use of the flat-topped nut seat 15 is not always essential in the practice of the present invention and, hence, the arm body 4 shown in FIG. 2B has no flat-topped nut seat.

Figure 4A:
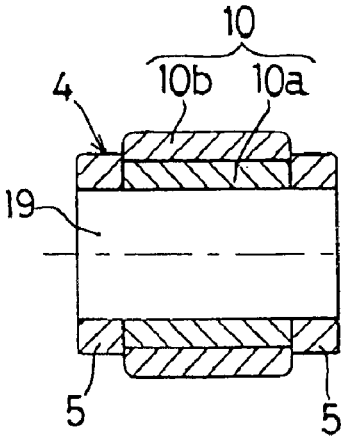
FIGS. 4A to 4C are transverse sectional views showing rollers according to the present invention, respectively.

The roller 10 shown in FIG. 1 is rotatably mounted on a support axle 19 rigidly supported by the opposite side walls 5 so as to extend therebetween. Specifically, the support axle 19 has its opposite ends firmly received in corresponding bearing holes 16 defined in the opposite side walls 5. As best shown in FIG. 4A, the roller 10 is of a double roller structure made up of an inner roller element 10*a* and an outer roller element 10*b*. The inner roller element 10*a* is rotatably mounted on the support axle 19, with a slidable bearing interface defined consequently between an inner peripheral surface of the inner roller element 10*a* and an outer peripheral surface of the support axle 19, and the outer roller element 10*b* is rotatably mounted on the inner roller element 10*a* with another slidable bearing interface defined consequently between an inner peripheral surface of the outer roller element 10*b* and an outer peripheral surface of the inner roller element 10*a*.

Figure 4B:
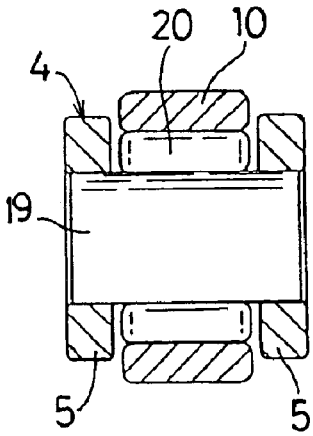

Alternatively, as shown in FIG. 4B, the roller 10 may be employed in the form of an outer race of a rolling bearing which includes, in addition to the outer race, a multiplicity of rolling elements 20 such as needle rollers. As shown therein, the roller 10 may be rotatably mounted on the support axle 19 with the rolling elements 20 interposed between it and the support axle 19.

Figure 4C:
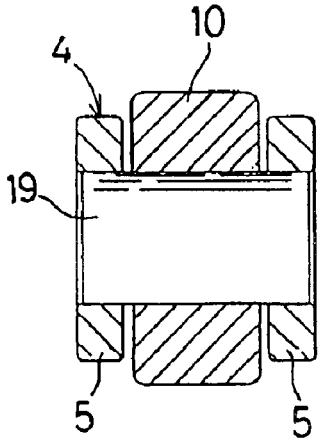

While the roller 10 shown in FIG. 4A may be referred to as a double roller type and the roller 10 shown in FIG. 4B may be referred to as a rolling bearing type, the roller 10 may be of a single roller type made up of a single roller integer as shown in FIG. 4C where a slide contact is desired.

The arm body 4 shown in and described with reference to FIGS. 1 and 2 is preferably made of a steel material such as a case hardened steel (for example, SCM 415), of a kind tempered after having been carburized. The effective case depth of the steel material hardened by the carburizing treatment is preferably within the range of 0.4 to 1.5 mm and, more preferably, within the range of 0.4 to 0.9 mm.

With the rocker arm 1 of the structure described hereinabove, by adjusting the position of the adjustment screw 7 relative to the screw mount 9 of the arm body 4, that is, by adjusting the extent to which the adjustment screw 7 is screwed relative to the internally threaded hole 12 in the screw mount 9 of the arm body 4, the opening of the valve body integral or connected with the valve stem 3*a* can be adjusted as can readily be understood by those skilled in the art. Since the adjustment screw 7 is, after having been engaged in the internally threaded hole 12 defined in the arm body 4, fixed in position by the fastening and lock nuts 13 and 14 that are successively threaded onto the screw shank 7*a* thereof, an undesirable backlash which would occur between the external helical thread of the screw shank 7*a* of the adjustment screw 7 and the mating internal helical thread of the internally threaded hole 12 in the screw mount 9 can be effectively eliminated, thereby avoiding the loosening of the adjustment screw 7. This elimination of the backlash is effective to allow the opening of the valve body at one end of the valve stem 3*a* to be controlled consistently so that the internal combustion engine can operate properly. Also, generation of undesirable noises such as chattering or rattling sounds which would otherwise result from the backlash occurring in the threaded engagement between the adjustment screw 7 and the screw mount 9 can be suppressed advantageously.

It is to be noted that since the adjustment screw 7 is threadingly engaged in the internally threaded hole 12, the backlash removal action as the double nuts can be obtained from the internally threaded hole and the nut to a certain extent, that is, any possible occurrence of backlash between the threaded shank 7*a* and the screw mount 9 can be suppressed to a certain extent, even where a single nut such as the fastening nut 13 is employed. However, the internally threaded hole 12 defined in the screw mount 9 of the arm body 4, in combination with the single nut, is ineffective to exert the backlash removal action sufficiently. In other words, the use of the single nut on the adjustment screw 7 is rather ineffective to substantially completely eliminate the occurrence of the backlash. Accordingly, in the practice of the present invention, the use is made of the two nuts, that is, fastening and lock nuts 13 and 14 to ensure that the adjustment screw 7 can be kept consistently in position relative to the screw mount 9 and, hence, the arm body 4 without substantially accompanied by the backlash.

In addition, considering that the arm body 4 is of one-piece construction prepared from the plate metal by the use of any known press work to represent a generally inverted U-sectioned configuration, the resultant rocker arm 1 of the present invention has numerous advantages in terms of weight, number of manufacturing steps and cost and also has an increased physical strength. Although the depth of the internally threaded hole 12 in the screw mount 9 for threading engagement with the adjustment screw 7 is more or less limited particularly where the plate material for the arm body 4 has a wall thickness limited to a relatively small value to achieve reduction in weight of the resultant arm body 4, the use of the double nuts 13 and 14 discussed above is effective to firmly position the adjustment screw 7 relative to the screw mount 9 without allowing the adjustment screw 7 to be loosened. Accordingly, the present invention is effective to compensate for one of demerits of the rocker arm of a kind prepared from the plate metal, thereby making it possible to provide a comprehensively excellent rocker arm 1.

Figure 5:
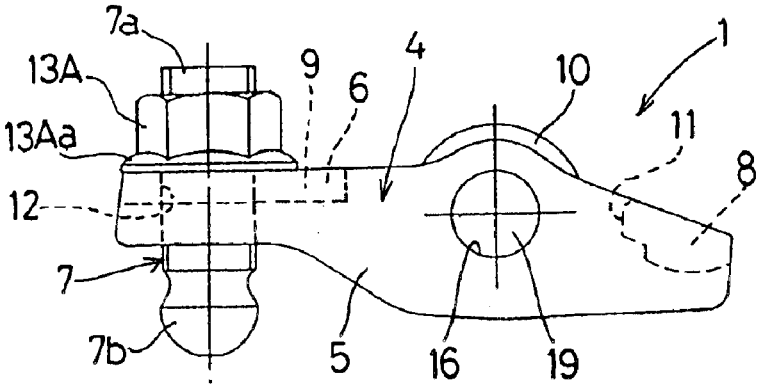
FIG. 5 is a side view of the rocker arm according to a further preferred embodiment of the present invention.
Figure 6A:
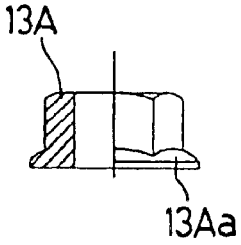
FIGS. 6A to 6C are side views, with a portion cut out, showing different flanged nuts that can be employed in association with the rocker arm of the present invention, respectively.

A second preferred embodiment of the present invention will now be described with particular reference to FIGS. 5 and 6. The embodiment shown in FIGS. 5 and 6 is similar to the first embodiment shown in and described with reference to FIGS. 1 to 4, but differs therefrom in that instead of the two nuts employed in the first embodiment, a single flanged nut 13A is employed in the embodiment of FIGS. 5 and 6. As best shown in FIG. 5, the flanged nut 13A having a radially outwardly extending round flange 13Aa is threadingly mounted on that portion of the screw shank 7*a* of the adjustment screw 7 which protrudes outwardly upwardly from the screw mount 9. The flanged nut 13A so far shown in FIG. 5 is of a type shown in FIG. 6A wherein an annular end face of the flange 13Aa which may be held in contact with the upper surface of the screw mount 9 is flat.

It is to be noted that, instead of the use of the flanged nut 13A having the flat annular end face as shown in FIG. 6A, the flanged nut 13A may be employed of a type wherein the flange 13Aa has an inner peripheral corner depleted radially inwardly thereof (or radially outwardly of an internally threaded hole of the nut 13A) to define a counterbore 18. Alternatively, the flanged nut 13A of a type wherein that annular end face of the flange 13Aa is rounded inwardly to represent an annular spherical end face or a generally annular conical end face as shown in FIG. 6C may be employed equally.

Where the flanged nut 13A is employed as hereinabove described, the surface area of contact between the flanged nut 13A and the upper surface of the screw mount 9 and, hence, that of the top connecting wall 6 can be advantageously increased and, therefore, a localized concentration of the pressure which would otherwise be imposed by the nut on a relatively narrow region of the upper surface of the screw mount 9 if no flange were formed in such nut can be lessened. In other words, the presence of the flange 13Aa is effective to distribute the pressure over a relatively large region of the upper surface of the screw mount 9. Accordingly, the possibility can be substantially eliminated or reduced wherein an annular portion of the upper surface of the screw mount 9 aligned with an annular end face of the flangeless nut may be undesirably depressed, so that the loosening of the adjustment screw 7 can be avoided.

Figure 6B:
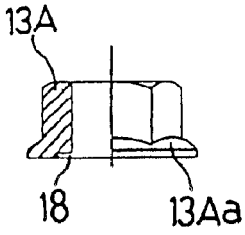
Figure 6C:
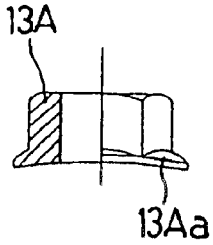

In the meantime, where of the two nuts employed in the first described embodiment of the present invention, the fastening nut 13 that is held in contact with the screw mount 9 is employed in the form of the flanged nut 13A as shown in any one of FIGS. 6A to 6C, not only can the backlash removal action be obtained by the double nuts, but also any undesirable depression of that annular portion of the upper surface of the screw mount 9 discussed above can be substantially eliminated because of the presence of the flange 13Aa, thereby facilitating avoidance of the undesirable loosening or backlash of the adjustment screw 7 relative to the screw mount 9.

Other structural features of and effects brought about by the rocker arm 1 according to the second embodiment of the present invention are similar to those in the first described embodiment and, therefore, the details thereof are not reiterated for the sake of brevity.

Figure 7:
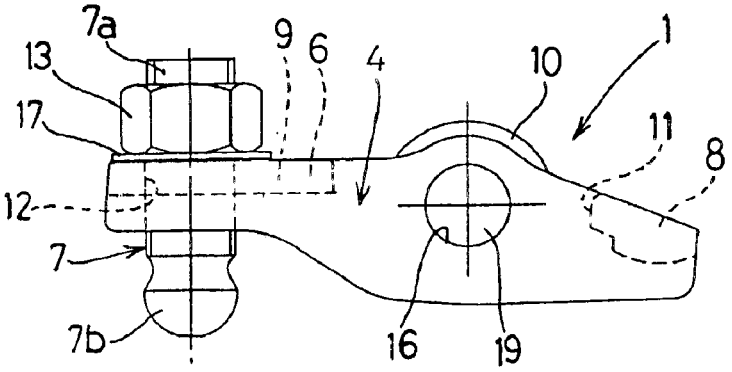
FIG. 7 is a side view of the rocker arm according to a still further preferred embodiment of the present invention.

FIG. 7 illustrates the rocker arm 1 according to a third preferred embodiment of the present invention. This embodiment is similar to the first described embodiment, but differs therefrom in that instead of the use of the two nuts employed in the first embodiment, a single nut 13 is employed in combination with a washer 17 as shown therein. Specifically, as shown in FIG. 7, the fastening nut 13 is threadingly mounted on that portion of the screw shank 7*a* of the adjustment screw 7, which protrudes outwardly upwardly from the screw mount 9, with the washer 17 clamped between the fastening nut 13 and the screw mount 9. The washer 17 is preferably of a size having an outer diameter greater than the maximum outer diameter of the hexagonal fastening nut 13 so that an undesirable localized concentration of the pressure which would otherwise be imposed by the nut on a relatively narrow region of the upper surface of the screw mount 9 can be substantially eliminated or lessened.

Thus, the intervention of the washer 17 between the fastening nut 13 and the screw mount 9 is effective to allow the contact pressure, imposed from the fastening nut 13 on the screw mount 9, to be distributed over a relatively large region of the upper surface of the screw mount 9, to thereby avoid the depression of the upper surface of the screw mount 9 and facilitate avoidance of the undesirable loosening or backlash of the adjustment screw 7 relative to the screw mount 9.

Other structural features of and effects brought about by the rocker arm 1 according to the third embodiment of the present invention are similar to those in the first described embodiment and, therefore, the details thereof are not reiterated for the sake of brevity.

Figure 8:
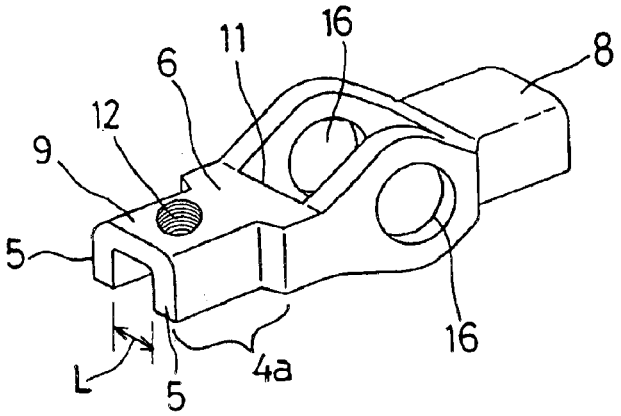
FIG. 8 is a perspective view of the arm body of the rocker arm according to a still further preferred embodiment of the present invention.
Figure 9A:
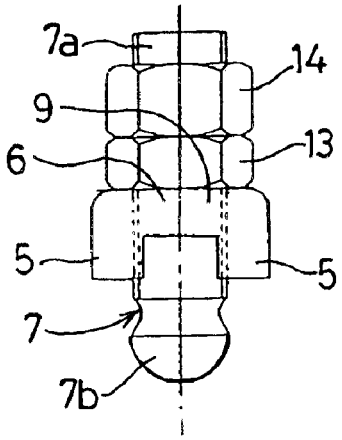
FIGS. 9A and 9B are a front elevational view and a transverse sectional view of the adjustment screw employed in the rocker arm shown in FIG. 7, respectively.
Figure 9B:
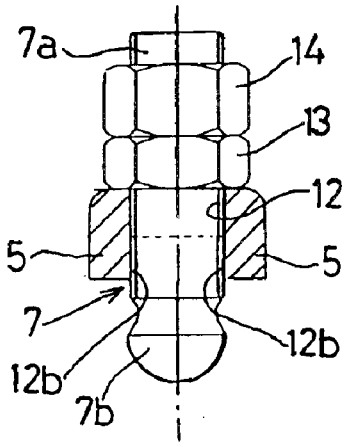
Figure 10A:
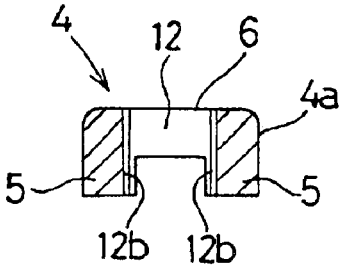
FIG. 10A is a transverse sectional view of a portion of the arm body of the rocker arm of FIG. 8, where a screw hole is defined.
Figure 10B:
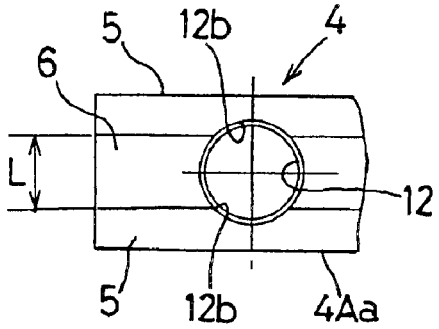
FIG. 10B is a bottom plan view of that portion of the arm body shown in FIG. 10A.

A further preferred embodiment of the present invention is shown in FIGS. 8 to 10. While the embodiment shown in FIGS. 8 to 10 is similar to the embodiment shown in and described with reference to FIGS. 1 to 4, it differs therefrom in that in the embodiment shown in FIGS. 8 to 10, respective portions of inner surfaces of the opposite side walls 5 which confront with each other at a location immediately below the internally threaded hole 12 are formed with helically extending partial threads 12*b* that are continued from the internally helically extending threads of the internally threaded hole 12, so that when the adjustment screw 7 is threadingly inserted into the internally threaded hole 12, the screw shank 7*a* can threadingly engage the partial threads 12*b* defined in those portions of the inner surfaces of the opposite side walls 5. For this purpose, at least respective portions of the opposite side walls 5 aligned with a passage of the adjustment screw 7 through the internally threaded hole 12 are spaced an internal distance L that is smaller than the diameter of the internally threaded hole 12.

So far employed in the embodiment shown in FIGS. 8 to 10, respective end portions of the opposite side walls 5 depending from the screw mount 9 are narrowed as at 4*a*, and the internally threaded hole 12 and the helically extending partial threads 12*b* are formed in respective inner surfaces of the narrowed side wall portions 4*a*. It is, however, to be noted that instead of the use of the local narrowed side wall portions 4*a*, the arm body 4 may have the opposite side walls 5 narrowed in an inner span to the distance L over the entire length thereof.

Figure 11A:
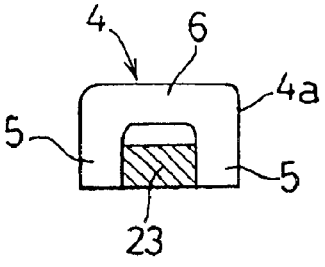
FIGS. 11A and 11B are views similar to FIGS. 10A and 10B, respectively, showing a still further embodiment of the present invention.
Figure 11B:
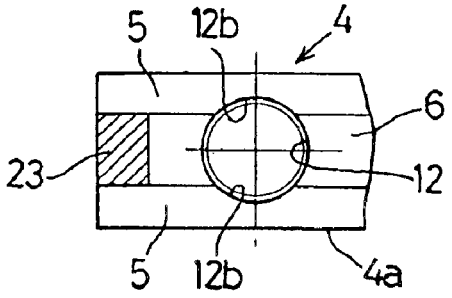

As is the case with the first described embodiment, the adjustment screw 7 is, after having been threaded into the internally threaded hole 12 and the partial threads 12*b* in the respective end portions of the opposite side walls 5, locked in position with the fastening and lock nuts 13 and 14 fastened to that portion of the screw shank 7*a* extending outwardly upwardly from the screw mount 9. Other structural features of and effects brought about by the rocker arm 1 according to the embodiment shown in FIGS. 8 to 10 are similar to those in the first described embodiment and, therefore, the details thereof are not reiterated for the sake of brevity.

Where the partial threads 12*b* are defined in the respective inner surfaces of the opposite side walls 5 in face-to-face relation with each other as described hereinabove, the adjustment screw 7 can be engaged not only with the screw mount 9 through the internally threaded hole 12, but also with the opposite side walls 5 through the partial threads 12*b*. Thus, since those portions of the opposite side walls 5 are utilized to define an extension of an internal helical thread continued from that of the internally threaded hole 12, the adjustment screw 7 can firmly be threaded at an increased threading strength. According to the embodiment shown in FIGS. 8 to 10, a sufficient threading strength and a sufficient strength of that portion of the arm body 4 adjacent and around the internally threaded hole 12 can be secured with no need to increase the wall thickness of the plate metal used as a material for the arm body 4.

Where the partial threads 12*b* are employed in the opposite side wall 5 of the arm body 4 as shown and described in connection with the previous embodiment, one end of the arm body 4 provided with the hole 12 may have a bridge insert 23 to connect the opposite side walls 5 together as shown in FIGS. 11A and 11B. This bridge insert 23 may be rigidly secured to respective ends of the opposite side walls 5 by means of any suitable method such as by the use of a welding or bonding technique.

The use of the bridge insert 23 to connect the opposite side walls 5 together is effective to avoid any possible outward deployment of such opposite side walls 5, that is, the partial threads 12*b* to thereby avoid an eventual loosening of the adjustment screw 7.

It is to be noted that the embodiment shown in and described with reference to FIGS. 8 to 10 can be equally applied to the embodiment in which the flanged nut 13A is employed as shown in FIG. 5 and also to the embodiment in which the washer 17 is employed as shown in FIG. 7, so that the adjustment screw 7 can be firmly retained in position relative to the screw mount 9 in a manner similar to that afforded by the embodiment shown in and described with reference to FIGS. 8 to 10.

Figure 12:
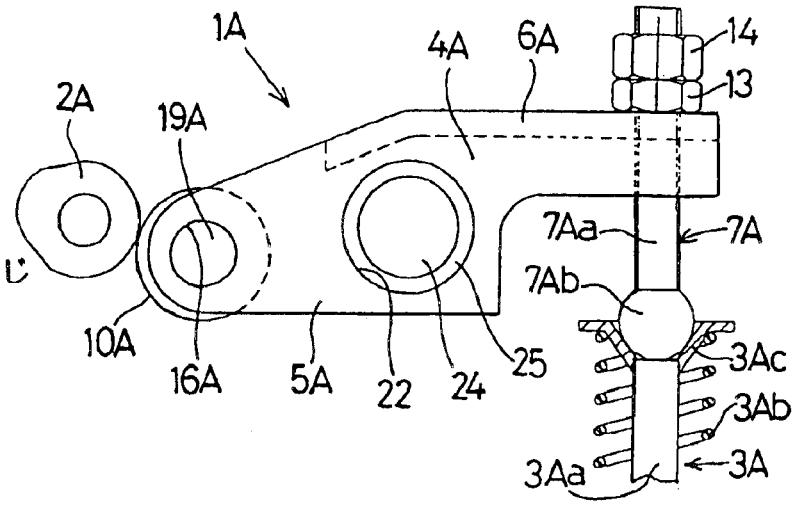
FIG. 12 is a side view of the rocker arm according to a still further preferred embodiment of the present invention.
Figure 13A:
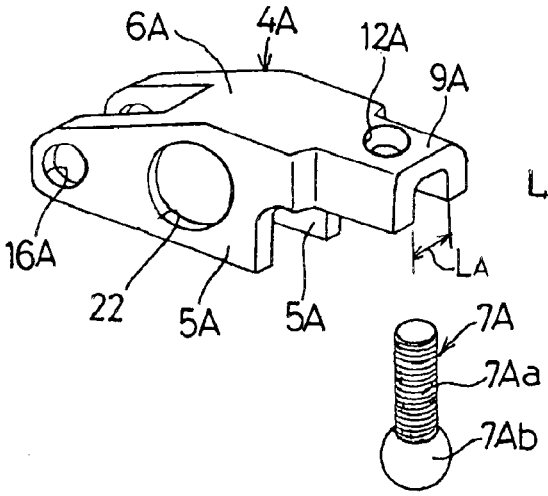
FIG. 13A is a perspective view of the rocker arm of FIG. 12, showing the relation between the arm body and the adjustment screw.
Figure 13B:
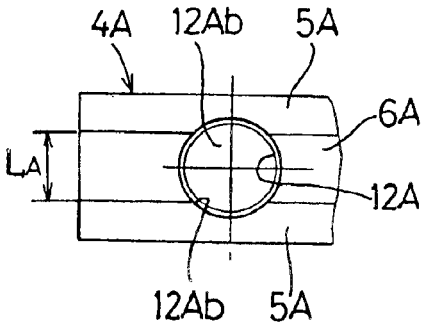
FIG. 13B is a bottom plan view of that portion of the arm body of the rocker arm shown in FIG. 13A.

A still further preferred embodiment of the present invention is shown in FIGS. 12 and 13. The embodiment shown therein is directed to the rocker arm 1A of a center pivot type in which the rocker arm 1A is rockingly supported at a generally intermediate portion thereof. As is the case with the rocker arm 1 of the end pivot type described hereinbefore, the rocker arm 1A shown therein is mounted on an internal combustion engine and above a cylinder head (not shown) in a well known manner and is utilized to operate, i.e., selectively open and close a valve body (not shown), located at a lower end of a valve member 3A, as the rocker arm 1A is rocked by a cam 2A.

More specifically, the rocker arm 1A includes a generally elongated arm body 4A of a generally inverted U-sectioned configuration opening downwardly and is rockingly supported at a generally intermediate portion thereof by means of a support axle 24. The illustrated rocker arm 1A has one of its opposite ends carrying an adjustment screw 7A which serves as a valve drive member, not a pivot member, while a roller 10A rollingly engageable with the cam 2A is rotatably mounted on the other of the opposite ends of the rocker arm 1A. The adjustment screw 7A includes an externally helically threaded screw shank 7Aa having a lower end formed integrally with, or otherwise connected rigidly with a rounded or spherical valve drive piece 7Ab.

The valve member 3A includes a valve stem 3Aa, a valve body (not shown) formed integrally with, or otherwise rigidly connected with a lower end of the valve stem 3Aa, and a generally dish-shaped seat member 3Ac fixedly mounted on an upper end of the valve stem 3Aa. This valve stem 3Aa is normally biased upwardly, as viewed in FIG. 12, by a compression spring 3Ab that is located therearound and seated at one end against the engine cylinder head and at the opposite end against the dish-shaped seat member 3Ac. This valve stem 3Aa moves up and down depending on the action of the cam 2A.

Referring particularly to FIGS. 12 and 13, the arm body 4A is of one-piece construction prepared from a single plate metal such as a steel plate by the use of any known press work and including a pair of parallel side walls 5A and a top connecting wall 6A bridging between those side walls 5A. The rocker arm 1A mounted on the engine cylinder head has its top connecting wall 6A positioned on one side opposite to the valve member 3A, hence the engine cylinder head.

The illustrated arm body 4A has a straight side profile so far shown therein, but may have an angled side profile. While the opposite side walls 5A extend over the entire length of the rocker arm 1A, the top connecting wall 6A from which the opposite side walls 5A depend extends most of the length of the rocker arm 1A, leaving a roller window adjacent the cam 2A so that the roller 10A can be partially exposed for contact with the cam 2A. A pivot axle 24 is received in pivot holes 22, respectively defined in the side walls 5A, through corresponding bushings 25. Respective end portions of the opposite side walls 5A adjacent the roller 10A are formed with bearing holes 16A, and the roller 10A is rotatably mounted on a support axle 19A that is fixedly received at its opposite ends in the corresponding bearing holes 16A. The roller 10A employed in this embodiment may be of a structure shown in and described with reference to any of FIGS. 4A to 4C.

The opposite end portion of the top connecting wall 6A remote from the roller window in which the roller 10A is situated rotatably defines a screw mount 9A that is formed with an internally helically threaded hole 12A defined therein for receiving the adjustment screw 7A as will subsequently be detailed. The adjustment screw 7A having the externally helically threaded screw shank 7Aa is mounted on the screw mount 9A with the screw shank 7Aa threadingly inserted through the threaded hole 12A so that an upper end portion of the screw shank 7Aa can protrude a distance outwardly above the screw mount 9A. The fastening and lock nuts 13 and 14 discussed previously are fastened to the upper end portion of the screw shank 7Aa in tight contact with each other to thereby lock the adjustment screw 7A in position relative to the screw mount 9A and, hence, the arm body 4A in a manner similar to that hereinbefore described.

As is the case with the embodiment shown in and described with reference to FIGS. 8 to 10, respective portions of inner surfaces of the opposite side walls 5A which confront with each other at a location immediately below the internally threaded hole 12A are formed with helically extending partial threads 12Ab that are continued from the internally helically extending threads of the internally threaded hole 12A. For this purpose, respective portions of the opposite side walls 5A aligned with a passage of the adjustment screw 7A through the internally threaded hole 12A are spaced an internal distance $L_A$ that is smaller than the diameter of the internally threaded hole 12A. This can be accomplished by forming that end portion of the arm body 4A, where the internally threaded hole 12A is located, to represent a local narrowed side wall portions 4Aa with the internally threaded hole 12A and the partial threads 12Ab being subsequently formed in the screw mount 9A and those portions of the opposite side walls 5A, respectively.

It is to be noted that instead of the formation of the local narrowed side wall portions 4Aa, the arm body 4A may be formed to have the opposite side walls 5A spaced over the entire length thereof a distance equal to the distance $L_A$ assumed by the local narrowed side wall portions 4Aa.

As described above, the adjustment screw 7A is threadingly inserted into the internally threaded hole 12A so as to extend therethrough with the externally helically extending threads of the screw shank 7Aa engaged with the internally helically extending threads of the internally threaded holes 12A and also with the partial threads 12A. The fastening and lock nuts 13 and 14 are subsequently successively threaded onto that end portion of the screw shank 7Aa protruding outwardly upwardly from the screw mount 9A.

In a broad aspect of the present invention, however, the partial threads 12Ab defined in the respective portions of the inner surfaces of the opposite side walls 5A may not be always essential and may be dispensed with accordingly.

In the embodiment shown in and described with reference to FIGS. 12 and 13, the rocker arm 1A is of the center pivot type and, hence, the adjustment screw 7A is provided as a valve drive member. Even in this embodiment, the adjustment screw 7A is utilized to adjust the opening of the valve body of the valve member 3A. Considering that the adjustment screw 7A is locked in position relative to the screw mount 9A after it has been threaded into the threaded hole 12A in the screw mount 9A of the arm body 4A and the double nuts 13 and 14 have subsequently fastened to the upper end portion of the adjustment screw 7A successively, any undesirable backlash which would occur between the external helical thread of the screw shank 7Aa of the adjustment screw 7 and the mating internal helical thread of the internally threaded hole 12A in the screw mount 9 can be effectively eliminated. This elimination of the backlash is effective to allow the opening of the valve body at one end of the valve stem 3Aa to be controlled consistently so that the internal combustion engine can operate properly. Also, since the partial threads 12Ab are employed in the opposite side wall 5 of the arm body 4 in continuity with the internally helically extending thread of the threaded hole 12A, a sufficient threading strength can be secured.

Other structural features of and effects brought about by the rocker arm 1A according to the embodiment shown in and described with reference to FIGS. 12 and 13 are similar to those in the first described embodiment and, therefore, the details thereof are not reiterated for the sake of brevity.

It is also to be noted that one or both of the embodiment in which the flanged nut 13A is employed as shown in FIG. 5 and the embodiment in which the washer 17 is employed as shown in FIG. 7 can be equally applied to even the embodiment of the rocker arm 1A of the center pivot type as in the embodiment shown in and described with reference to FIGS. 12 and 13.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in describing any one of the foregoing embodiments of the present invention, the arm body 4 or 4A has been shown and described as representing the generally inverted U-sectioned configuration opening downwardly, the arm body 4 or 4A may be of a generally U-sectioned configuration opening upwardly.

Also, although in describing any one of the foregoing embodiments, the arm body 4 or 4A has been described and shown as prepared from the plate metal by the use of any known press work, the present invention can be equally applied to the rocker arm of a kind formed by a casting technique.

Accordingly, such changes and modifications are, unless they depart from the scope of the present invention as delivered from the claims annexed hereto, to be construed as included therein.

What is claimed is:

1. A rocker arm capable of being rockingly driven by a cam for selectively opening and closing a valve mounted on a cylinder head of an internal combustion engine, which rocker arm comprises:

an arm body prepared from a single plate metal by a press work, and having first and second ends opposite to each other, the first end of the arm body having an internally threaded hole defined therein;

an adjustment screw which serves as a pivot member or a valve drive member, the adjustment screw being threaded into the internally threaded hole in the first end of the arm body with one end portion of the adjustment screw protruding outwardly from the first end of the rocker arm; and the adjustment screw being fixed relative to the arm body by means of a structure selected from the group consisting of a first structure in which two nuts are threaded onto such one end portion of the adjustment screw in overlapping relation with each other, a second structure in which a flanged nut is threaded onto such one end portion of the adjustment screw, and a third structure in which a nut is threaded onto such one end portion of the adjustment screw with a washer intervening between such nut and the first end of the arm body, wherein the arm body has a generally inverted U-sectioned configuration including a pair of opposite side walls and a connecting wall bridging between the opposite side walls, the internally threaded hole is defined in a first end portion of the connecting wall of the arm body, and respective portions of mutually confronting inner surfaces of the opposite side walls have helical partial threads therein in continuity with an internally helically extending thread of the internally threaded hole, to threadingly receive the adjustment screw.

2. The rocker arm as claimed in claim 1, wherein where the first structure is employed to fix the adjustment screw relative to the arm body, one of the two nuts in contact with the first end of the arm body is a flanged nut.

3. The rocker arm as claimed in claim 1, wherein the adjustment screw includes a pivot piece provided at one end thereof and a valve abutment is defined at the second end of the arm body and a roller engageable with the cam is fitted to a portion generally intermediate of the arm body.

4. The rocker arm as claimed in claim 1, wherein the adjustment screw has one end provided with a valve drive piece and wherein the arm body is supported at a generally intermediate portion thereof for rocking motion and a roller engageable with the cam is fitted to the second end of the arm body.

5. The rocker arm as claimed in claim 1, wherein the flanged nut comprises a flange having a flat annular end face.

6. The rocker arm as claimed in claim 1, wherein the flanged nut comprises a flange having an inner peripheral corner depleted radially outwardly of an internally threaded hole, to define a counterbore.

7. The rocker arm as claimed in claim 1, wherein the flanged nut comprises a flange having an annular end face that is rounded inwardly to represent an annular spherical end face.

8. The rocker arm as claimed in claim 1, wherein the flanged nut comprises a flange having an annular end face that is rounded inwardly to represent an annular conical end face.

* * * * *

UNITED STATES PATENT AND TRADEMARK OFFICE

CERTIFICATE OF CORRECTION

PATENT NO. : 6,863,040 B2
DATED : March 8, 2005
INVENTOR(S) : Masahiko Kataoka et al.

It is certified that error appears in the above-identified patent and that said Letters Patent is hereby corrected as shown below:

Column 13,
Line 62, after "body" insert -- , --.

Signed and Sealed this

Second Day of May, 2006

JON W. DUDAS
*Director of the United States Patent and Trademark Office*